US010134556B2

(12) United States Patent
Zheng et al.

(10) Patent No.: US 10,134,556 B2
(45) Date of Patent: Nov. 20, 2018

(54) COMPOSITE FUSE ELEMENT AND METHOD OF MAKING

(71) Applicant: LITTELFUSE, INC., Chicago, IL (US)

(72) Inventors: Ben Zheng, Jiangsu (CN); Style Liu, Jiangsu (CN); Marko Arciaga, Batangas (PH); Anthony Minervini, Palo Hills, IL (US)

(73) Assignee: Littelfuse, Inc., Chicago, IL (US)

( * ) Notice: Subject to any disclaimer, the term of this patent is extended or adjusted under 35 U.S.C. 154(b) by 39 days.

(21) Appl. No.: 14/346,420

(22) PCT Filed: Oct. 19, 2012

(86) PCT No.: PCT/US2012/061039

§ 371 (c)(1),
(2) Date: Mar. 21, 2014

(87) PCT Pub. No.: WO2013/059604

PCT Pub. Date: Apr. 25, 2013

(65) Prior Publication Data

US 2014/0240082 A1 Aug. 28, 2014

Related U.S. Application Data

(60) Provisional application No. 61/548,781, filed on Oct. 19, 2011.

(51) Int. Cl.
*H01H 85/38* (2006.01)
*H01H 69/02* (2006.01)
(Continued)

(52) U.S. Cl.
CPC ..... *H01H 85/38* (2013.01); *H01H 69/02* (2013.01); *H01H 85/0418* (2013.01); *H01H 85/06* (2013.01); *H01H 85/08* (2013.01)

(58) Field of Classification Search
CPC .... H01H 85/0418; H01H 85/06; H01H 85/08; H01H 85/10; H01H 85/38; H01H 85/463; H01H 69/02
(Continued)

(56) References Cited

U.S. PATENT DOCUMENTS 3,259,719 A * 7/1966 Innis ..... H01H 85/044 337/159
3,935,553 A * 1/1976 Kozacka ..... H01H 85/0456 337/159
(Continued)

FOREIGN PATENT DOCUMENTS

CN 1365131 8/2002
CN 1925087 3/2007
(Continued)

OTHER PUBLICATIONS

English translation of Office Action dated Feb. 17, 2015 from corresponding Japanese patent application No. JP2014-537292 filed Oct. 19, 2012.

*Primary Examiner* — Anatoly Vortman
*Assistant Examiner* — Jacob Crum

(57) ABSTRACT

An improved fuse element for use in a circuit protection fuse. The fuse element may include an insulating substrate portion and a conductive metallic portion disposed on at least one surface of the insulating substrate portion, wherein the metallic portion extends along, and is in continuous, intimate contact with the substrate portion. When the metallic portion melts and separates upon the occurrence of an overcurrent condition, the substrate portion bridges the resulting gap that is formed in the metallic portion and provides electrical arc suppression therein.

21 Claims, 11 Drawing Sheets

(51) Int. Cl.
*H01H 85/041* (2006.01)
*H01H 85/06* (2006.01)
*H01H 85/08* (2006.01)

(58) Field of Classification Search
USPC ..... 337/231
See application file for complete search history.

(56) References Cited

U.S. PATENT DOCUMENTS 4,692,734 A * 9/1987 Swanson ..... H01H 85/055 337/159
5,027,101 A * 6/1991 Morrill, Jr. ..... H01H 85/0411 337/273
5,726,621 A * 3/1998 Whitney ..... H01H 85/0411 337/283
5,805,046 A * 9/1998 Hassler ..... H01H 9/102 337/158
6,838,972 B1 6/2005 Minervini et al.
2002/0097547 A1* 7/2002 Fukuoka ..... H01H 69/022 361/118
2002/0101323 A1 8/2002 Ranjan et al.
2004/0034993 A1* 2/2004 Rybka ..... H01C 1/1406 29/623
2005/0134422 A1* 6/2005 Okuniewicz ..... H01H 85/042 337/159
2006/0119465 A1 6/2006 Dietsch
2006/0170528 A1* 8/2006 Fukushige ..... H01H 85/0411 337/297
2008/0218305 A1* 9/2008 Bender ..... H01H 69/022 337/297
2010/0194519 A1* 8/2010 Harris ..... H01H 85/045 337/227

FOREIGN PATENT DOCUMENTS

CN 101253594 8/2008
JP 49059957 S 6/1974
JP H02098440 U 8/1990
JP 2002203468 A 7/2002

* cited by examiner

COMPOSITE FUSE ELEMENT AND METHOD OF MAKING

FIELD OF THE DISCLOSURE

The disclosure relates generally to the field of circuit protection devices, and more particularly to a fuse having a composite fuse element including an insulating, arc-suppressing substrate.

BACKGROUND OF THE DISCLOSURE

Fuses have long been used in electrical devices for providing an interruptible electrical connection between a source of electrical power and a component in an electrical circuit that is to be protected. For example, upon the occurrence of an overcurrent condition in a circuit, such as may result from a short circuit or other sudden electrical surge, an element within in the fuse may separate and interrupt the flow of electrical current to a protected circuit component, thereby preventing or mitigating damage to the component that could otherwise result if the overcurrent condition were allowed to persist.

One type of fuse that is well known in the art includes a hollow fuse body and a fuse element disposed within the hollow body. For example, FIG. 1 illustrates a side view of a conventional fuse 100 having a hollow, tubular fuse body 110. The fuse 100 includes a first end cap 130, a second end cap 140, and a fuse element 120 disposed within, and extending through, a cavity 150 of the hollow fuse body 110 to form an electrical connection between the end caps 130 and 140. The fuse element 120 is formed of an electrically conductive material having a relatively low melting point. The end caps 130 and 140 are made from an electrically conductive material and fit over the longitudinal ends of the fuse body 110 to provide electrical contact with the fuse element 120. The fuse element 120 is connected to the end caps 130 and 140 by solder fillets 155, which are disposed at opposite ends of the fuse body 110. The cavity 150, defined by an interior surface 115 of the fuse body 110, contains an insulative filler 160 which may be a powdered or granular non-conductive material, such as a sand.

When the fuse element 120 melts or separates due to a predetermined, excessive amount of current flowing through the fuse element 120, an electric arc forms between the un-melted portions of the element. The arc grows in length as the separating portions of the fuse element 120 recede from each other until the voltage required to sustain the arc is higher than the available voltage in the protected circuit, thus terminating the current flow. It is therefore desirable to suppress such arcs as quickly as possible to limit the time after the excessive current is reached until current flow is arrested. The insulative filler material 160 acts to suppress the electrical arc in the exemplary conventional fuse 100 by filling the gap that forms between melted portions of the fuse element 120. However, because of limited surface area contact between the filler material 160 and the fuse element 120, the time required to quench an arc may be still be excessive (i.e. not sufficiently expedient to prevent damage to a protected circuit component). It is therefore apparent that a need exists to improve arc quenching in fuses.

SUMMARY

In accordance with the present disclosure, a fuse having a composite fuse element that exhibits improved arc quenching characteristics and a method of making the same are disclosed.

An exemplary embodiment of a fuse in accordance with the present disclosure includes a hollow fuse body defining a central cavity, a fuse element disposed within the cavity and an insulating substrate portion and a conductive metallic portion disposed on at least one surface of the insulating substrate portion. A first end cap is connected to a first end of the metallic portion and a second end cap is connected to a second end of the metallic portion.

An alternative embodiment of a fuse element in accordance with the present disclosure can include an insulating substrate portion and a conductive metallic portion having a helical shape. The metallic portion at least partially surrounds, and is in continuous, intimate contact with the substrate portion.

An exemplary embodiment of a method for making a fuse element in accordance with the present disclosure can include providing an insulating substrate portion and applying a metallic portion to at least one surface of the substrate portion. The metallic portion provides an electrically conductive pathway from a first end of the substrate portion to a second end of the substrate portion.

An alternative embodiment of a method for making a fuse element in accordance with the present disclosure can include providing an insulating substrate and forming rows of perforations in the substrate. The rows extend along parallel, laterally spaced lines, and forming patterned, electrically conductive metallic portions on opposing, major surfaces of the substrate, wherein each metallic portion extends to at least one of the perforations. The method may further include depositing electrically conductive paste in each of the perforations, wherein the paste is in contact with at least one of the metallic portions, and dicing the substrate along lines that laterally bisect each row of perforations, wherein the metallic portions and paste depositions define a helical, electrically conductive pathway that at least partially surrounds, and is in continuous, intimate contact with each diced substrate portion.

BRIEF DESCRIPTION OF THE DRAWINGS

By way of example, specific embodiments of the disclosed device will now be described, with reference to the accompanying drawings, in which.

DETAILED DESCRIPTION

Figure 1:
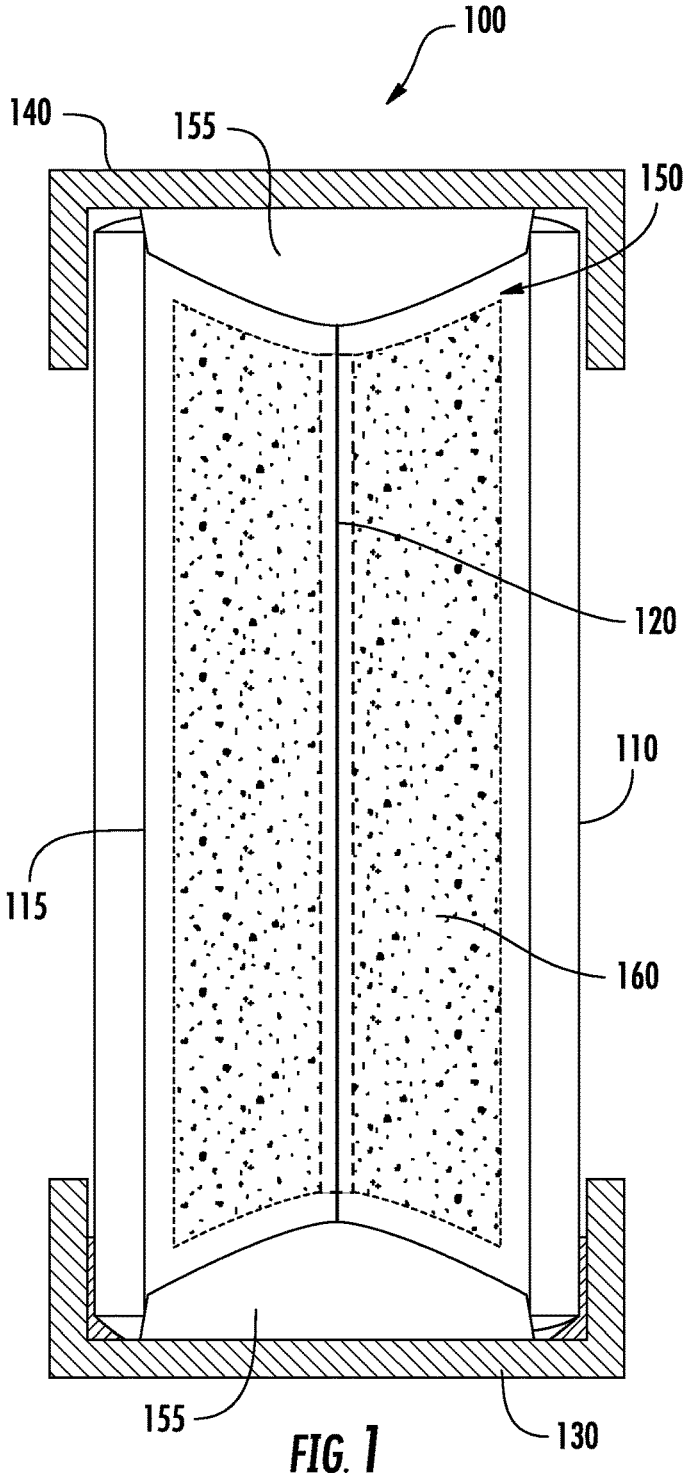
FIG. 1 Prior Art
FIG. 1 is a side cross sectional view illustrating a prior art fuse.

Various embodiments of a fuse having a composite fuse element including a ceramic substrate and a method for making the same in accordance with the present disclosure will now be described more fully hereinafter with reference to the accompanying drawings, in which preferred embodiments of the invention are shown. This invention, however, may be embodied in many different forms and should not be construed as limited to the embodiments set forth herein. Rather, these embodiments are provided so that this disclosure will be thorough and complete, and will fully convey the scope of the invention to those skilled in the art. In the drawings, like numbers refer to like elements throughout.

For the sake of convenience and clarity, terms such as "front," "rear," "top," "bottom," "up," "down," "vertical," "horizontal," "lateral," and "longitudinal" may be used herein to describe the relative placement and orientation of various structures and components described below. Said terminology will include the words specifically mentioned, derivatives thereof, and words of similar import.

Figure 2A:
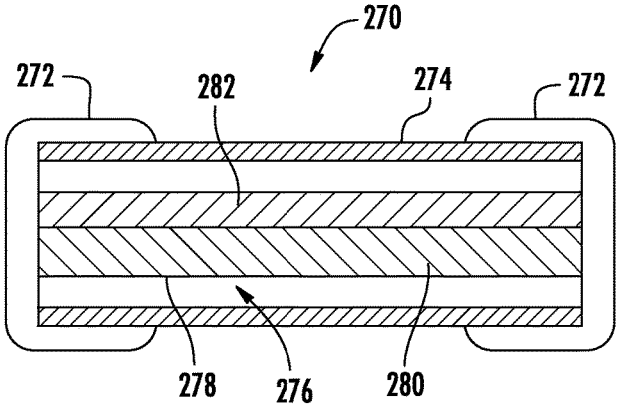
FIG. 2*a* is a side cross sectional view illustrating a fuse in accordance with an embodiment of the present disclosure.

FIG. 2*a* illustrates a side cross-sectional view of an exemplary fuse 270 that is consistent with certain embodiments of the present disclosure. The fuse 270 includes conductive end caps 272 that fit over opposing longitudinal ends of a tubular fuse body 274, such as by press-fitting or other means of secure engagement, to define an enclosed cavity 276 therein. The end caps 272 may be formed wholly or partially of any suitable electrically conductive material, including, but not limited to, copper or brass, and may be coated with additional materials such as tin or silver. The fuse body 274 can be formed of any suitable insulative material, including, but not limited to, glass, ceramic, plastic, and various composites, and may have any suitable cross sectional shape, such as round, rectangular, triangular, or irregular. The cross sectional size and shape of the end caps 272 may substantially match the cross sectional size and shape of the fuse body 274 to facilitate mating engagement therebetween. The cavity 276 of the fuse 270 may be filled with air, inert gas, various powdered or granular insulative materials, or may be vacuum sealed.

A composite fuse element 278 may extend between the end caps 272 and includes an insulative substrate portion 280 and a conductive metallic portion 282. The substrate portion 280 of the fuse element 278 may be formed of any suitable insulative material, including, but not limited to, ceramic, glass, plastic, and various composites. The metallic portion 282 may be formed of any known metallic material that is suitable for use as a conductive fuse element, including, but not limited to, tin, lead, and zinc. The substrate portion 280 and the metallic portion 282 are disposed in a parallel, flatly abutting relationship within the cavity 276 and are in intimate contact with one another. The longitudinal ends of the fuse element 278 may be connected to the end caps 272 with any suitable, electrically conductive means of affixation, such as with solder fillets or with various conductive adhesives, for example.

Figure 2B:
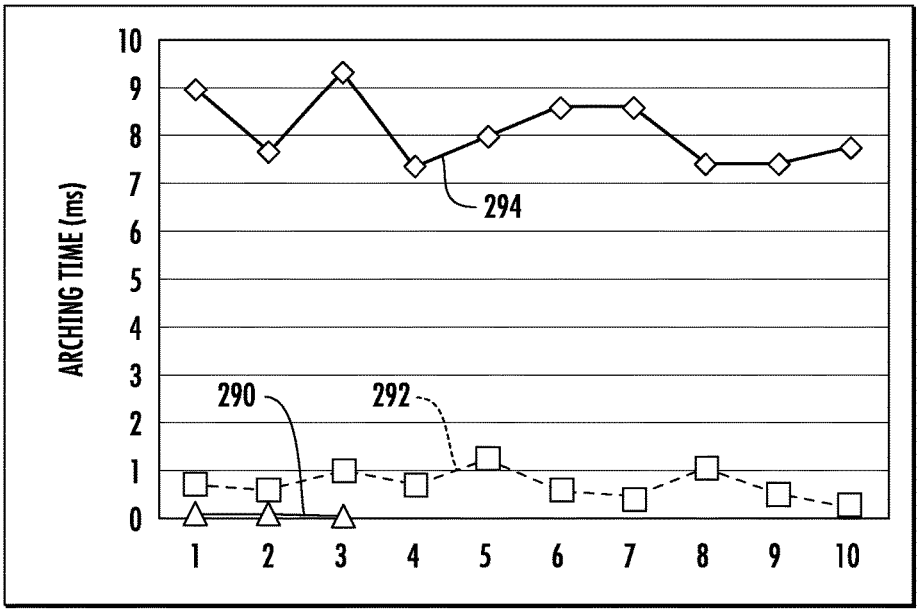
FIG. 2*b* is graph that presents arc time data for a fuse according to the fuse embodiment shown in FIG. 2, as well as arc time data for two conventional fuses.

It has been found through experimentation that the composite fuse element 278 provides improved resistance to electrical arc formation upon the occurrence of an overcurrent condition as compared to a fuse having a conventional fuse element defined only by a conductive metallic member that may or may not be surrounded an insulative filler material. For example, the graph shown in FIG. 2*b* presents exemplary arcing time data for several fuses having uniform sizes and current ratings. In particular, arcing time data for a fuse having a composite fuse element in accordance with the present disclosure is represented by curve 290 in FIG. 2*b*, while curves 292 and 294 in FIG. 2*b* represent arcing time data for two fuses having conventional, non-composite fuse elements. Of course, it will be appreciated by those of ordinary skill in the art that variations in fuse ratings and fuse size will result in corresponding variations in arcing time. As shown in FIG. 2*b*, the arcing time for the fuse in accordance with the present disclosure was about 100 microseconds or less, while the arcing time for the fuses having conventional fuse elements was on the order of one millisecond (as shown by curve 292) or many milliseconds (as shown by curve 294). It has therefore been demonstrated that the arc quenching capability of a composite fuse element in accordance with the present disclosure is significantly better than that of conventional fuse elements.

The improved arc suppression of the fuse 270 relative to conventional fuses is a direct result of the metallic portion 282 of the fuse element 278 being in continuous, intimate contact with the insulating portion 280 of the fuse element 278. Particularly, the insulating portion 280, which does not melt or break apart upon the occurrence of an overcurrent condition, extends across a gap in the metallic portion 282 that is formed when the metallic portion 282 melts or breaks apart (i.e., when longitudinally-opposing, unmelted portions of the metallic portion 282 melt and recede longitudinally away from each other). The insulating portion 280 thus acts as an arc suppressor within the longitudinally expanding gap, with the area of contact between the insulating portion 280 and the metallic portion 282 being greater than the area of contact between filler materials and metallic fuse elements in conventional fuses (as shown in FIG. 1).

Figure 3A:
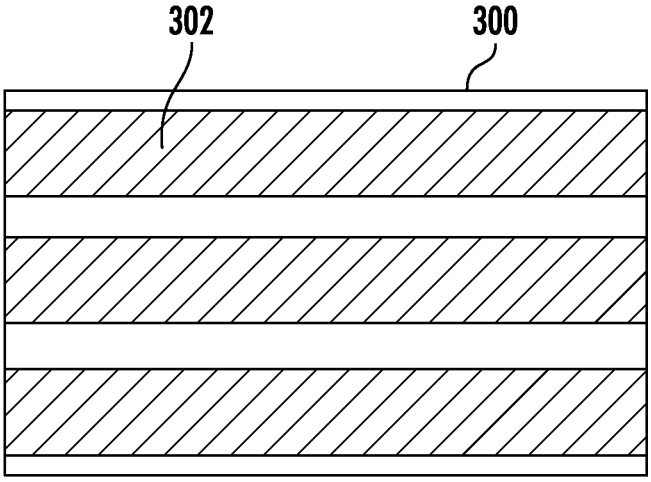
FIGS. 3*a*-3*d* illustrate an exemplary method of making the fuse shown in FIG. 2*a*.

FIGS. 3*a*-3*d* depict an exemplary method of making a fuse 270 that is consistent with the present disclosure. Referring first to FIG. 3*a*, an insulating substrate 300, such as may be formed of ceramic or other insulative materials as discussed above, is provided with overlaying metallic portions 302. The metallic portions 302 may be formed as strips, and in various embodiments may be produced and applied to the insulating substrate 300 using screen printing, plating, vapor deposition, or other known techniques for forming and depositing coatings or layers upon a substrate. The width and thickness of the metallic portions 302 may be varied according to the desired characteristics of the composite fuse element to be formed. For example, the metallic portion of a fuse element that is designed to have a relatively higher current limit may be made wider and/or thicker than the metallic portion of a fuse element that is designed to have a relatively lower current limit.

Figure 3B:
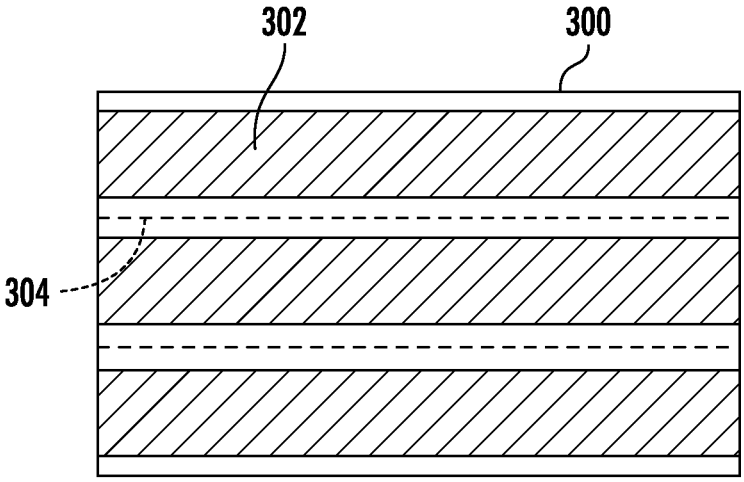
Figure 3C:
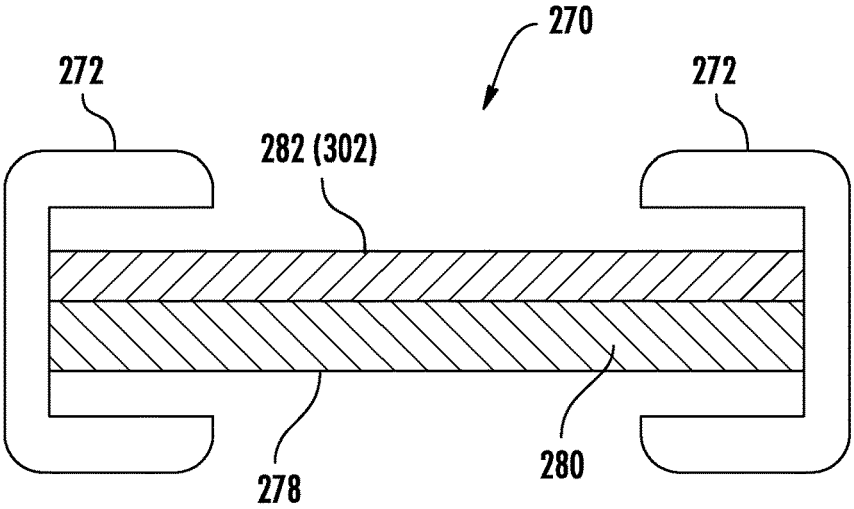
Figure 3D:
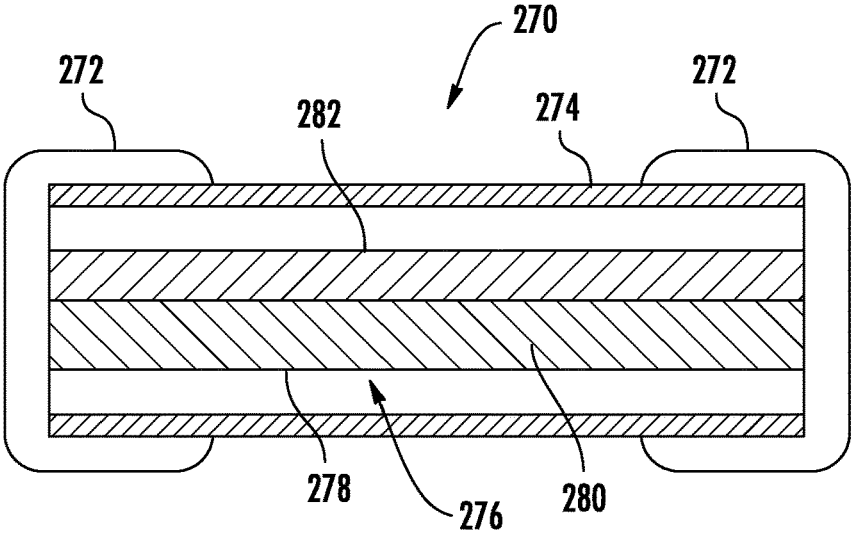

In FIG. 3*b*, the substrate 300 is prepared for dicing to form several individual composite fuse elements 278 (as shown in FIG. 2*a* and FIGS. 3*c*-*d*). For example, scribing lines 304 may be made in the substrate 300, laterally-intermediate the metallic portions 302 as shown. Although not shown, it is contemplated that the metallic portions 302 may be similarly prepared for being cut to a desired width.

Figure 3E:
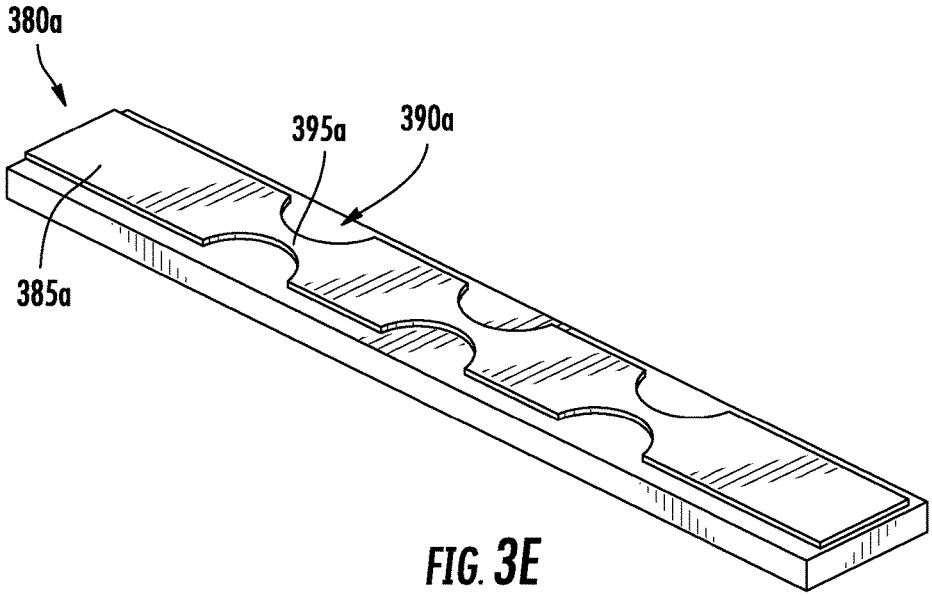
FIGS. 3*e*-3*f* are perspective views illustrating alternative composite fuse elements in accordance with the present disclosure.
Figure 3F:
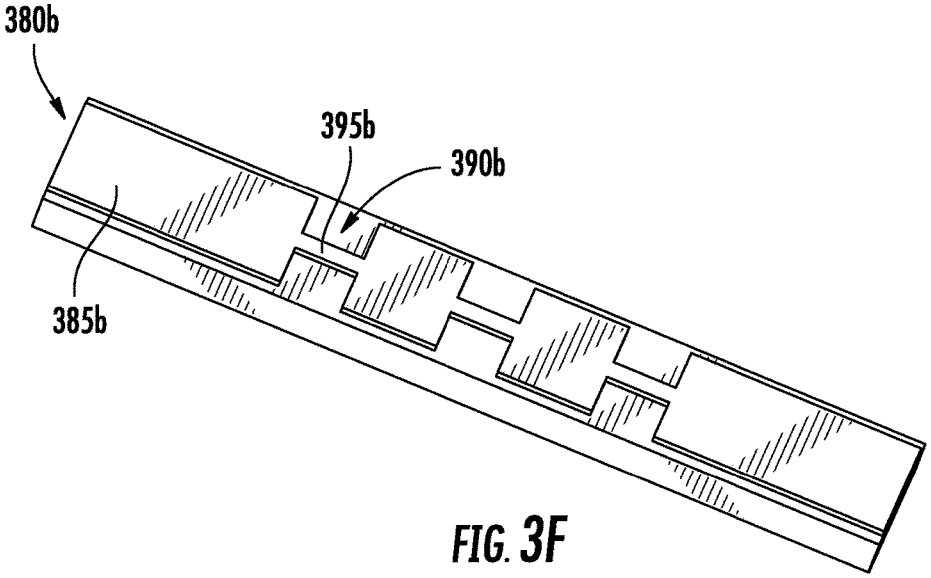

Referring to FIGS. 3*e* and 3*f*, alternative embodiments of a fuse element are contemplated in which various weak points are formed in the metallic portion thereof to "split" electrical arcing that may occur upon melting of the metallic portions of the fuse elements during an overcurrent condition. In particular, FIG. 3*e* illustrates a fuse element 380*a* that includes a metallic portion 385*a* having a series of semicircle cutouts 390*a* formed along each of its lateral edges, such as by cutting or etching. The resulting narrow portions 395*a* of the metallic portion 385*a*, located laterally intermediate the semicircle cut-outs 390*a*, serve as weak points that accommodate splitting of electrical arcing when the narrow portions 395*a* melt upon the occurrence of an overcurrent condition.

Similarly, FIG. 3*f* illustrates a fuse element 380*b* that includes a metallic portion 385*b* having a series of rectangular cutouts 390*b* formed along each of its lateral edges. The resulting narrow portions 395*b* of the metallic portion 385*b*, located laterally intermediate the rectangular cut-outs 390*b*, serve as weak points that facilitate splitting of electrical arcing when the narrow portions 395*b* melt upon the occurrence of an overcurrent condition as described above. It will be appreciated by those of ordinary skill in the art that thinned or narrowed weak points similar to those described above may be formed in a fuse element using various techniques, and that such weak points may be formed with many different shapes, sizes, and configurations. All such variations are contemplated and may be implemented without departing from the present disclosure.

In FIG. 3*c*, the metallic portion 282 of a single diced composite fuse element 278 (cut from the substrate 300 and metallic portion 302 shown in FIG. 3*b*) is connected to end caps 272, such as with solder, conductive epoxy, or other electrically conductive means of affixation (not shown). The metallic portion 282 thus forms a continuous, electrically conductive pathway between the end caps 272. The insulating substrate portion 280 may or may not be affixed to the end caps 272. While the substrate portion 280 is shown as having longitudinal ends that extend completely to the end caps 272, it is contemplated that the substrate portion 280 may alternatively be shorter than the metallic portion 282, and that one or both of the longitudinal ends of the metallic portion 282 may be spaced apart from their respective end caps 272. In FIG. 3*d*, a fuse body 274 is installed intermediate the end caps 272 to house the composite fuse element 278 and to define a cavity 276. As described above, the cavity 276 may optionally be filled with an insulative material or gas (not shown) to further enhance the arc-quenching capability of the fuse 270.

FIGS. 4*a*-4*d* depict top perspective and bottom perspective views of an alternative composite fuse element 400 in accordance with further embodiments of the present disclosure. The composite fuse element 400 includes a metallic portion 402 having a three dimensional, substantially helical shape that is wrapped around, and that is in continuous, intimate contact with an insulating substrate portion 404. The metallic portion 402 of the fuse element 400 may be formed of any known metallic material that is suitable for use as a conductive fuse element, including, but not limited to, tin, lead, and zinc. The substrate portion 404 may be formed of any suitable insulative material, including, but not limited to, ceramic, glass, plastic, and various composites.

The substrate portion 404 is shown as having a rectangular cross sectional shape with opposing top and bottom surfaces 412 and 416, but it is contemplated that the shape of the substrate portion 404 can be varied without departing from the present disclosure. For example, the substrate portion 404 may alternatively have a circular, triangular, or irregular cross sectional shape. It is further contemplated that the substrate portion 404 may be tubular with a hollow cavity extending longitudinally therethrough. Regardless of the particular shape or size of the substrate portion 404, the metallic portion 402 of the fuse element 400 should be helically wrapped about the substrate portion 404 in a closely conforming, flatly abutting relationship therewith.

Figure 4A:
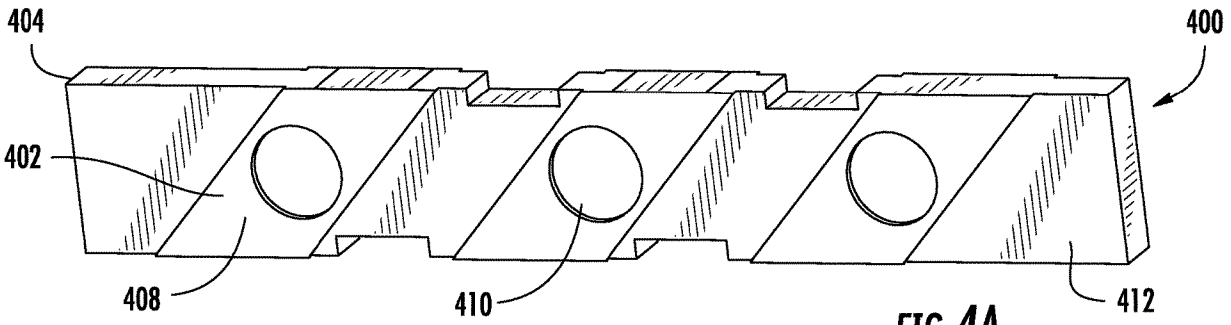
FIGS. 4*a*-4*d* are top perspective and bottom perspective views illustrating an alternative composite fuse element in accordance with the present disclosure.
Figure 4B:
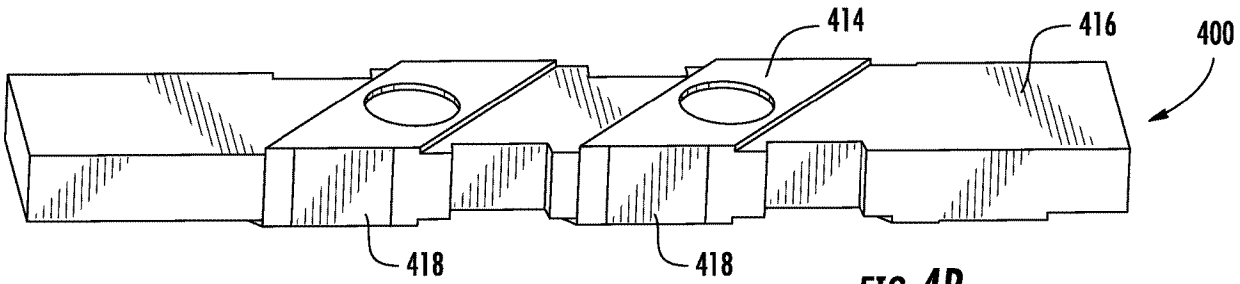

Referring to FIG. 4*a*, the top surface portions 408 of the metallic portion 402 of the composite fuse element 400 may be arranged as evenly spaced, diagonally oriented strips on the top surface 412 of the substrate portion 404. Referring to FIG. 4*b*, the bottom surface portions 414 of the metallic portion 402 may be arranged on the bottom surface 416 of the substrate portion 404 in a manner similar to the top side portions 408. The bottom surface portions 414 are electrically conductively connected to the top surface portions 408 by side metallic portions 418 that extend perpendicularly between the lateral edges of the top surface portions 408 and the bottom surface portions 414. The metallic portion 402 thus forms a continuous, electrically conductive path having a shape that is substantially similar to that of a flat, helical ribbon that has been creased along lines corresponding to the lateral edges of the substrate portion 404. Thus, while the shape of the metallic portion 402 does not conform to the strict definition of the term "helix" as it is conventionally used, the terms "helix" and "helical" shall be defined herein to encompass the shape of the metallic portion 402 as it shown in the FIGS. 4*a* and 4*b*, as well as all conventional helices and variations thereon.

Figure 4C:
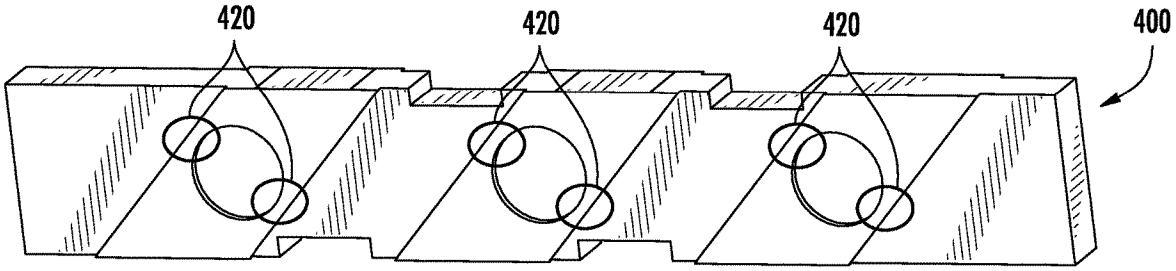
Figure 4D:
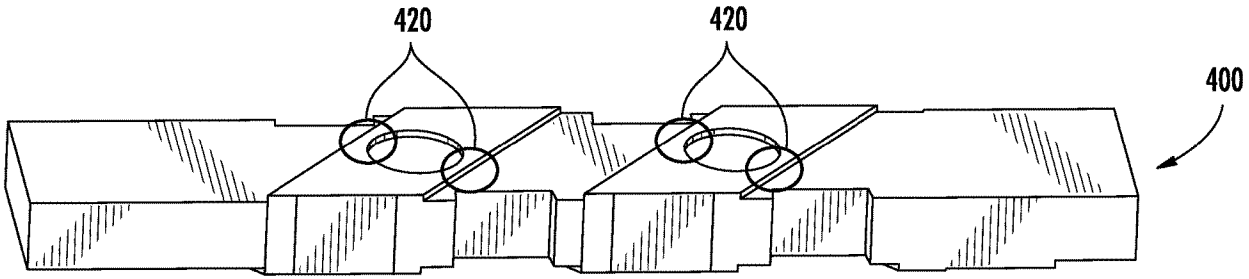

Referring to FIGS. 4*a* and 4*b*, apertures or holes 410 may be formed in the top surface portions 408 and bottom surface portions 414 of the metallic portion 402. The holes 410 are shown as being circular and extending across the majority of the longitudinal width of the top and bottom surface portions 408 and 414, but it is contemplated that the shape and size of the holes 410 can be varied without departing from the present disclosure. Referring to FIGS. 4*c* and 4*d*, the formation of the holes 410 creates weak points 420 in the metallic portion 402 that are significantly narrower than the imperforate areas of the top and bottom surface portions 408 and 414. Particularly, each hole 410 creates two adjacent weak points 420, as illustrated.

Since the weak points 420 in the metallic portion 402 are relatively narrow, they melt or break apart faster than the relatively wider, imperforate portions of the metallic portion 402 upon the occurrence of an overcurrent condition. The fuse element 400 therefore exhibits a faster circuit interrupt response than would be provided by an entirely imperforate metallic portion. The generally helical shape of the metallic portion 402 of the exemplary fuse element 400 provides a total of five top and bottom surface portions 408 and 412, and therefore a total of 10 weak points 420. Of course, a greater number of windings and corresponding holes 410 in the metallic portion 402 will provide a greater number of weak points 420. Accordingly, the helical metallic portion 402 facilitates a fuse element configuration in which a plurality of weak points can be compactly arranged within a fuse element of a given longitudinal length as compared to conventional, straight fuse elements. The fuse element 400 may thereby add to the breaking capacity of a fuse relative to conventional fuse elements of similar size. "Breaking capacity" is defined herein to mean the maximum current that can safely be interrupted by a fuse. At the same time, and as described above with respect to the fuse element 278, the fuse element 400 is resistant to electrical arcing because the metallic portion 402 is in continuous, intimate contact with the insulating substrate portion 404. Particularly, the substrate portion 404 bridges any gaps that may form in the metallic portion 402 upon metaling or breaking and thus acts as an arc suppressor.

Figure 5A:
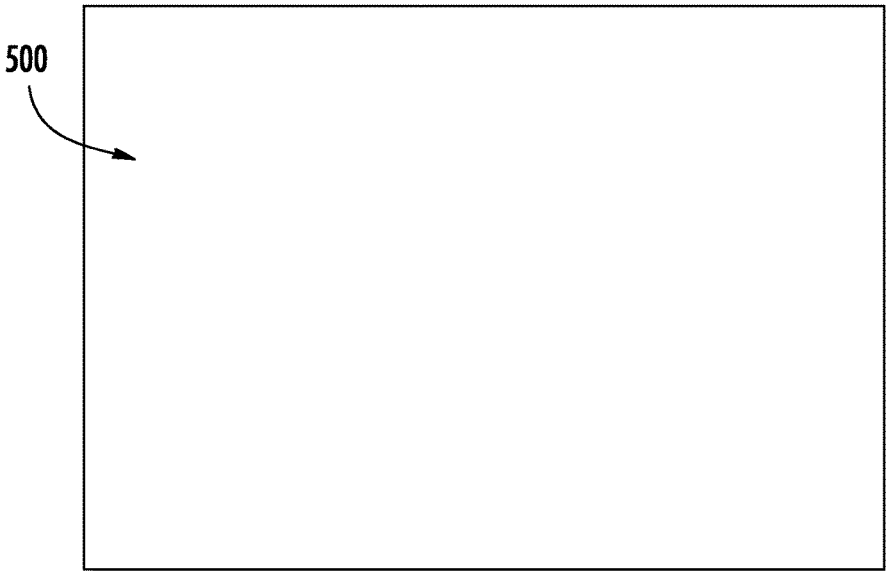
FIGS. 5*a*-5*f* illustrate an exemplary method of making the composite fuse element shown in FIGS. 4*a*-4*d*.
Figure 5B:
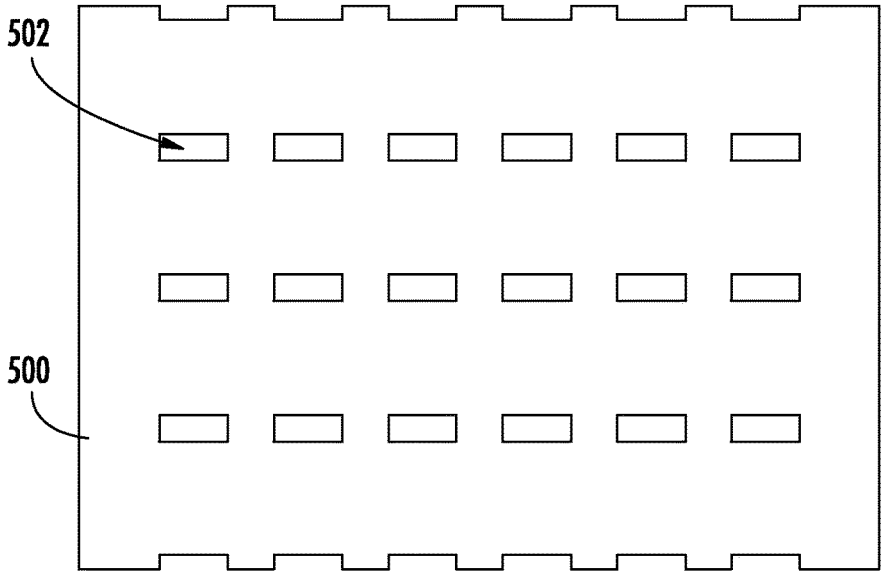

FIGS. 5*a*-5*d* depict an exemplary method of making a fuse 400 that is consistent with the present disclosure. In FIG. 5*a*, an insulating substrate 500 is provided which may be formed of, for example, a flat sheet of ceramic material, insulative organic material, flexible substrate material, or any other suitable insulative substrate material as discussed above. In FIG. 5*b*, a series of perforations or slots 502 are formed in the insulating substrate 500, such by using any of a variety of known techniques that will be familiar to those of ordinary skill in the art. The slots 502 may be formed along parallel, longitudinally extending, laterally spaced lines as shown.

Figure 5C:
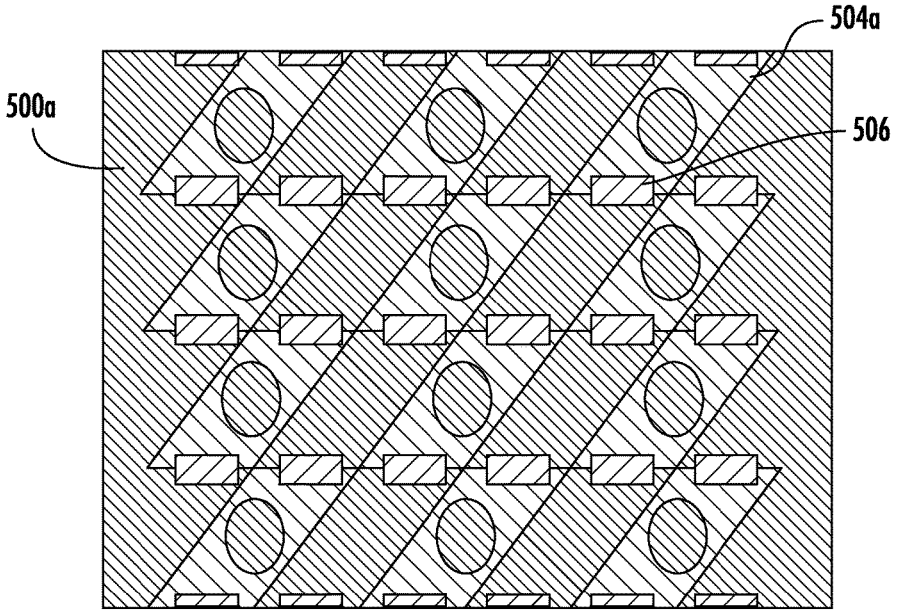
Figure 5D:
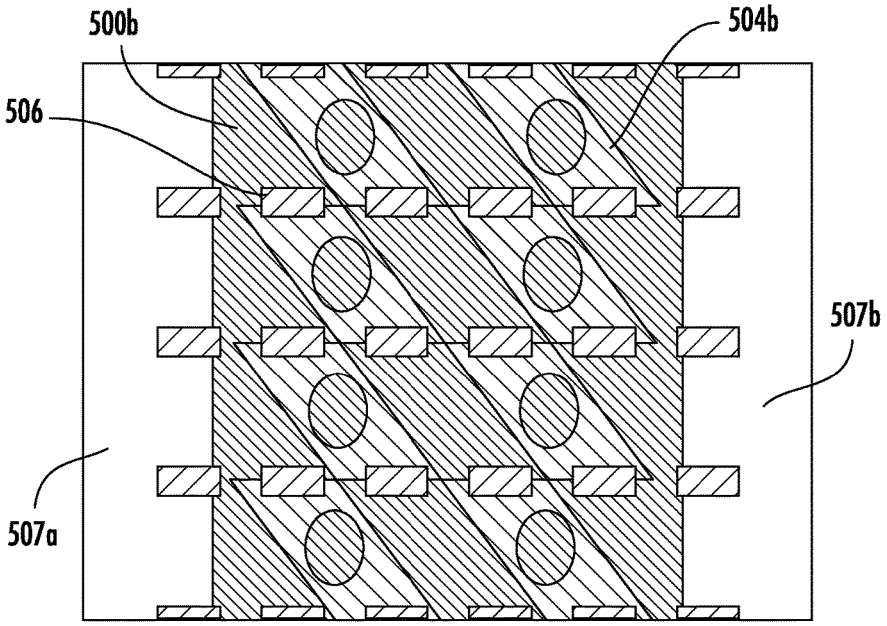

FIG. 5*c* illustrates a top surface 500*a* of the substrate 500 having exemplary patterned, parallelogram-shaped metallic portions 504*a* formed thereon, wherein each metallic portion 504*a* has a hole formed therethrough. Similarly, FIG. 5*d* illustrates a bottom surface 500*b* of the substrate 500 having exemplary patterned, parallelogram-shaped metallic portions 504*b* formed thereon, wherein each metallic portion 504*b* has a hole formed therethrough. The patterned metallic portions 504*a* and 504*b* may be produced and applied to the substrate 500 using screen printing, plating, vapor deposition, or other known techniques for forming and depositing coatings or layers upon a substrate. The lateral edges of the metallic portions 504*a* may be vertically aligned with the lateral edges of the metallic portions 504*b*.

A metallic paste 506 may be deposited in, and may substantially fill, each of the slots 502. The paste 506 may be formed of any suitable, electrically conductive material, and may be deposited in the slots 502 using any suitable deposition technique. The paste 506 provides an electrically conductive connection between the metallic portions 504*a* on the top surface 500*a* of the substrate 500 and the metallic portions 504*b* on the bottom surface 500*b* of the substrate 500 as further described below.

Optionally, metallic termination portions 507*a* and 507*b* may be deposited on the longitudinal ends of the bottom surface 500*b* of substrate 500. The termination portions 507*a* and 507*b* may be formed of any suitable, electrically conductive material and may be produced and applied to the substrate 500 using any of the layering and/or deposition techniques discussed above. The termination portions 507*a* and 507*b* may be disposed in direct or indirect electrically conductive contact with the metallic portions 504*a* and 504*b*, such as via the paste 506, for providing electrical connections between the metallic portions 504*a* and 504*b* and the end caps of a fuse as further described below.

Finally, the substrate 500 may be diced, such as by breaking or cutting the substrate 500 along longitudinally extending lines that laterally bisect each row of paste-filled slots 502, to produce individual fuse elements 400 as shown in FIGS. 4*a*-4*d* and 5*e*-5*f*. Although not shown, scribe lines may first be made in the substrate 500 and used as guides during dicing.

Figure 5E:
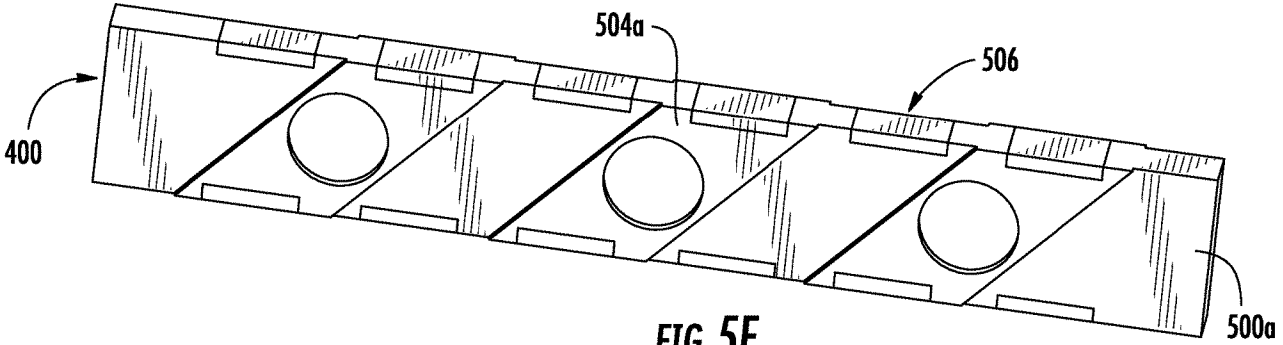
Figure 5F:
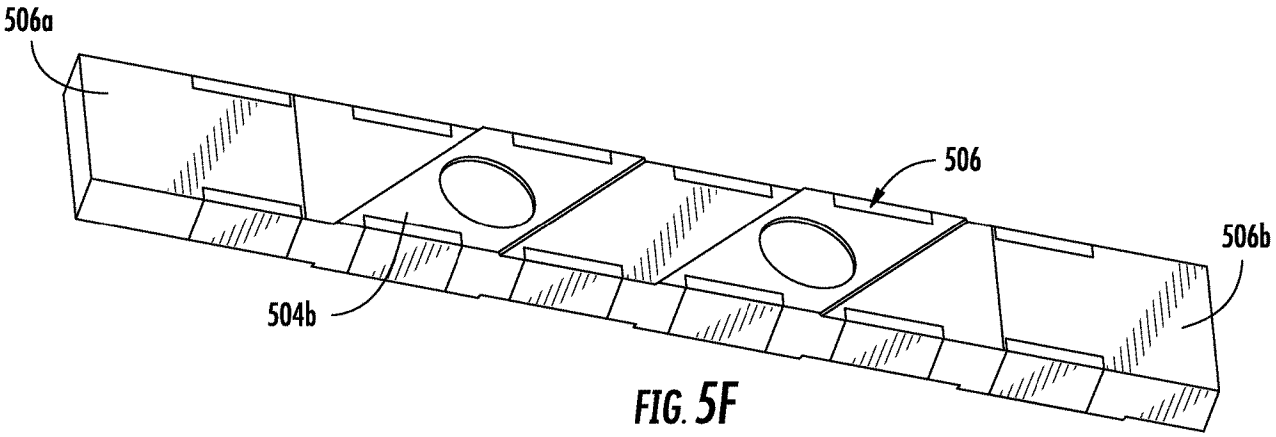

FIG. 5*e* and FIG. 5*f* illustrate perspective views of the top and bottom of the fuse element 400 after the substrate 500 is diced. As discussed above, the metallic paste 506 that was deposited in the slots 502 provides an electrical connection between the metallic portions 504*a* and 504*b* on the top and bottom sides of the fuse element 400, thereby creating a continuous, generally helical electrical pathway that wraps around, and that is in intimate contact with, the insulative substrate of the fuse element 400. The size and/or shape of the slots 502 and the amount of metallic paste 506 deposited therein may be adjusted in order to shrink or expand the electrical pathways created by the paste 506 and/or to provide wider or narrower lateral margins between individual fuse elements 400 for the dicing process. As discussed above, the metallic termination portions 507*a* and 507*b* are located on the longitudinal ends of the bottom fuse element 400 for providing electrical connections to the end caps of a fuse.

Figure 6:
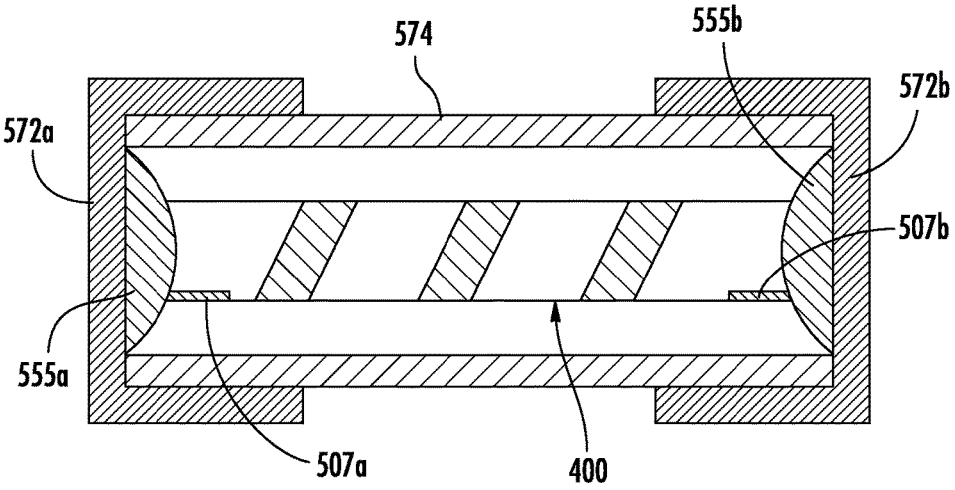
FIG. 6 illustrates an exemplary fuse that employs the fuse element shown in FIGS. 4*a*-4*d*.

FIG. 6 illustrates a side cross-sectional view of an exemplary fuse that employs the fuse element 400 described above, wherein the fuse element 400 is disposed within a tubular fuse body 574. The fuse 270 includes conductive end caps 572*a* and 572*b* that fit over opposing longitudinal ends of the fuse body 574, such as by press-fitting or other means of secure engagement. The end caps 572*a* and 572*b* may be formed wholly or partially of any suitable electrically conductive material, including, but not limited to, copper or brass that may or may not be coated with tin or silver. The fuse body 574 can be formed of any suitable insulative material, including, but not limited to, glass, ceramic, plastic, and various composites, and may have any suitable cross sectional shape, such as round, rectangular, triangular, or irregular. The cross sectional size and shape of the end caps 572*a* and 572*b* may substantially match the cross sectional size and shape of the fuse body 574 to facilitate mating engagement therebetween. The fuse body 574 may optionally be filled with air, inert gas, various powdered or granular insulative materials, or may be vacuum sealed.

The composite fuse element 400 may extend between the end caps 572*a* and 572*b*, and a solder fillet 555*a* may electrically connect the termination portion 507*a* of the fuse element 400 to the end cap 572*a*. Similarly, a solder fillet 555*b* may electrically connect the termination portion 507*b* of the fuse element 400 to the end cap 572*b*.

As used herein, an element or step recited in the singular and proceeded with the word "a" or "an" should be understood as not excluding plural elements or steps, unless such exclusion is explicitly recited. Furthermore, references to "one embodiment" of the present invention are not intended to be interpreted as excluding the existence of additional embodiments that also incorporate the recited features.

While certain embodiments of the disclosure have been described herein, it is not intended that the disclosure be limited thereto, as it is intended that the disclosure be as broad in scope as the art will allow and that the specification be read likewise. Therefore, the above description should not be construed as limiting, but merely as exemplifications of particular embodiments. Those skilled in the art will envision other modifications within the scope and spirit of the claims appended hereto.

The invention claimed is:

1. A fuse comprising:

a hollow fuse body defining a central cavity;

a fuse element disposed within the cavity and comprising:

an insulating substrate portion having a planar top surface, an opposing, planar bottom surface, and opposing side surfaces extending between the top surface and the bottom surface, the side surfaces having respective series of slots formed therein;

a plurality of electrically conductive metallic portions disposed on the top surface and the bottom surface of the insulating substrate portion, the slots at least partially filled with an electrically conductive material connecting the metallic portions on the top surface to the metallic portions on the bottom surface, wherein the metallic portions and the electrically conductive material in the slots define a single, continuous, electrically conductive, helical pathway that extends 720 degrees about an axis of the substrate portion from a first end of the substrate portion to a second end of the substrate portion; and a first end cap connected to a first end of the fuse element and a second end cap connected to a second end of the fuse element.

2. The fuse of claim 1, further comprising at least one cutout formed in the metallic portions.

3. The fuse of claim 2, wherein the at least one cutout is semicircular in shape.

4. The fuse of claim 2, wherein the at least one cutout is rectangular in shape.

5. The fuse of claim 1, further comprising at least one aperture formed in the metallic portions.

6. The fuse element of claim 1, wherein the metallic portions have at least one weak point that separates more quickly upon the occurrence of an overcurrent condition than other portions of the metallic portions.

7. The fuse of claim 1, wherein the cavity is at least partially filled with an insulative filler material.

8. A fuse element comprising:

an insulating substrate portion having a planar top surface an opposing, planar bottom surface, and opposing side surfaces extending between the top surface and the bottom surface, the side surfaces having respective series of slots formed therein; and a plurality of conductive metallic portions disposed on the top surface and bottom surface of the insulating substrate portion, the slots at least partially filled with an electrically conductive material connecting the metallic portions on the top surface to the metallic portions on the bottom surface to define a single, continuous, electrically conductive, helical pathway that extends 720 degrees about an axis of the substrate portion from a first end of the substrate portion to a second end of the substrate portion.

9. The fuse of claim 8, further comprising at least one aperture formed in the metallic portions.

10. The fuse element of claim 8, wherein the metallic portions have at least one weak point that separates more quickly upon the occurrence of an overcurrent condition than other portions of the metallic portions.

11. The fuse of claim 8, wherein the substrate portion has a rectangular cross sectional shape.

12. A method of making a fuse element comprising:

providing an insulating substrate portion having a planar top surface, an opposing, planar bottom surface, and opposing side surfaces extending between the top surface and the bottom surface, the side surfaces having respective series of slots formed therein;

applying a plurality of metallic portions to the top surface and bottom surface of the substrate portion; and at least partially filling the slots with an electrically conductive material connecting the metallic portions on the top surface to the metallic portions on the bottom surface;

wherein the metallic portions and the electrically conductive material in the slots define a single, continuous, electrically conductive, helical pathway that extends 720 degrees about an axis of the substrate portion from a first end of the substrate portion to a second end of the substrate portion.

13. The method of claim 12, further comprising forming at least one cutout in the metallic portions.

14. The method of claim 12, further comprising forming at least one aperture in the metallic portions.

15. The method of claim 12, further comprising forming at least one weak point in the metallic portions that separates more quickly upon the occurrence of an overcurrent condition than other portions of the metallic portions.

16. The method of claim 12, further comprising applying electrically conductive termination portions to opposite ends of a surface of the substrate portion, wherein the termination portions are in contact with the metallic portions.

17. A method of making a fuse element comprising:

providing an insulating substrate having a planar top surface and an opposing, planar bottom surface;

forming rows of perforations in the substrate, wherein the rows extend along parallel, laterally spaced lines;

forming patterned, parallelogram-shaped electrically conductive metallic portions on opposing, major surfaces of the substrate, wherein each metallic portion extends to at least one of the perforations;

depositing electrically conductive paste in each of the perforations, wherein the paste is in contact with at least one of the metallic portions; and dicing the substrate along lines that laterally bisect each row of perforations;

wherein the metallic portions and paste depositions define continuous, helical, electrically conductive pathways that extend 720 degrees about axes of respective diced substrate portions, and wherein the pathways are in continuous, intimate contact with, and extend from a first end to a second end of, the respective diced substrate portions.

18. The method of claim 17, further comprising applying electrically conductive termination portions to opposite ends of a surface of the substrate, wherein the termination portions are in contact with the metallic portions.

19. The method of claim 17, further comprising forming at least one cutout in the metallic portions.

20. The method of claim 17, further comprising forming at least one aperture in the metallic portions.

21. The method of claim 17, further comprising forming at least one weak point in the metallic portions that separates more quickly upon the occurrence of an overcurrent condition than other portions of the metallic portions.

* * * * *